US008414397B2

(12) United States Patent
Block et al.

(10) Patent No.: US 8,414,397 B2
(45) Date of Patent: Apr. 9, 2013

(54) GAMING TERMINAL NETWORK WITH A MESSAGE DIRECTOR

(75) Inventors: Rory L. Block, Carson City, NV (US); Christopher W. Blackburn, Reno, NV (US); Chih-Hui Jan, Reno, NV (US); James P. Simmermon, Reno, NV (US); Terry D. Warkentin, Carson City, NV (US)

(73) Assignee: WMS Gaming Inc., Waukegan, IL (US)

( * ) Notice: Subject to any disclaimer, the term of this patent is extended or adjusted under 35 U.S.C. 154(b) by 2042 days.

(21) Appl. No.: 10/629,110

(22) Filed: Jul. 29, 2003

(65) Prior Publication Data

US 2004/0185936 A1 Sep. 23, 2004

Related U.S. Application Data

(60) Provisional application No. 60/455,299, filed on Mar. 17, 2003.

(51) Int. Cl.
*A63F 9/24* (2006.01)

(52) U.S. Cl.
USPC ..... 463/42; 463/25; 705/39

(58) Field of Classification Search ..... 463/42, 463/27, 25; 726/5; 365/189.05
See application file for complete search history.

(56) References Cited

U.S. PATENT DOCUMENTS

| | | | | |
|---|---|---|---|---|
| 5,249,800 | A | 10/1993 | Hilgendorf et al. | 273/138 |
| 5,611,730 | A | 3/1997 | Weiss | 463/20 |
| 5,766,076 | A * | 6/1998 | Pease et al. | 463/27 |
| 5,790,789 | A | 8/1998 | Suarez | |
| 5,851,149 | A * | 12/1998 | Xidos et al. | 463/42 |
| 5,855,515 | A | 1/1999 | Pease et al. | 463/27 |
| 5,885,158 | A | 3/1999 | Torango et al. | 463/27 |
| 6,061,274 | A * | 5/2000 | Thibault et al. | 365/189.05 |
| 6,289,382 | B1 * | 9/2001 | Bowman-Amuah | 709/226 |
| 6,312,333 | B1 | 11/2001 | Acres | |
| 6,319,125 | B1 * | 11/2001 | Acres | 463/25 |
| 6,358,149 | B1 | 3/2002 | Schneider et al. | |

(Continued)

FOREIGN PATENT DOCUMENTS

| | | | |
|---|---|---|---|
| WO | WO-2007092608 | A2 | 8/2007 |
| WO | WO-2007092608 | A3 | 8/2007 |

OTHER PUBLICATIONS

Web Page, "Microsoft Massage Queuing (MSMQ) Center", www.microsoft.com/windows2000/technologies/communications/msmq/default.asp, Jun. 9, 2003, 17 pages.

Sabbouh, M. , et al., "World Wide Web Consortium", *Workshop on Web Servies*, (Apr. 2001),5 pgs.

(Continued)

*Primary Examiner* — Paul A D'Agostino
(74) *Attorney, Agent, or Firm* — Schwegman Lundberg & Woessner, P.A.

(57) ABSTRACT

A method and apparatus in a gaming network for transmitting event messages from gaming terminals to a central server and, consequently, routing each event message to an appropriate application. The system may include multiple gaming function specific servers with multiple applications on each server using a dedicated central server for message routing. In addition, this system can route secondary event messages generated by primary event messages. These secondary messages may be routed to other applications, other servers, or the gaming terminals. The system utilizes an association data structure in the central server to route messages without the need for embedded routing software code in each application, minimizing the need to rewrite software code that may result from any changes in gaming function or the applications that provide that functionality.

18 Claims, 8 Drawing Sheets

U.S. PATENT DOCUMENTS

| | | | | |
|---|---|---|---|---|
| 6,374,357 | B1 * | 4/2002 | Mohammed et al. | 726/5 |
| 6,430,562 | B1 | 8/2002 | Kardos et al. | |
| 6,473,829 | B1 | 10/2002 | Dahman et al. | 711/112 |
| 6,830,515 | B2 | 12/2004 | Rowe | |
| 6,922,685 | B2 | 7/2005 | Greene et al. | |
| 7,056,217 | B1 | 6/2006 | Pelkey et al. | |
| 2001/0014881 | A1 | 8/2001 | Drummond et al. | |
| 2002/0058550 | A1 | 5/2002 | Pace | |
| 2002/0115487 | A1 * | 8/2002 | Wells | 463/42 |
| 2003/0013531 | A1 * | 1/2003 | Rowe et al. | 463/42 |
| 2003/0028480 | A1 * | 2/2003 | Rowe | 705/39 |
| 2003/0064801 | A1 | 4/2003 | Breckner et al. | 463/30 |
| 2003/0069074 | A1 | 4/2003 | Jackson | 463/43 |
| 2003/0078103 | A1 | 4/2003 | LeMay et al. | 463/43 |
| 2003/0105825 | A1 | 6/2003 | Kring et al. | |
| 2003/0110242 | A1 | 6/2003 | Brown et al. | |
| 2003/0130040 | A1 * | 7/2003 | Dripps | 463/42 |
| 2003/0171149 | A1 | 9/2003 | Rothschild | |
| 2003/0212818 | A1 | 11/2003 | Klein et al. | |
| 2004/0002385 | A1 | 1/2004 | Nguyen | |
| 2004/0048669 | A1 * | 3/2004 | Rowe | 463/42 |
| 2004/0152511 | A1 | 8/2004 | Nicely et al. | |
| 2004/0162144 | A1 | 8/2004 | Loose et al. | |
| 2005/0192099 | A1 | 9/2005 | Nguyen et al. | |
| 2005/0283522 | A1 | 12/2005 | Parkkinen et al. | |
| 2006/0073887 | A1 | 4/2006 | Nguyen | |

OTHER PUBLICATIONS

"Stored Procedure", Wikipedia, <http://web.archive.org/web/20040905213803/http://en.wikipedia.0 rg/wi ki/Sto red_p rocedure>, (Sep. 5, 2004,).
"U.S. Appl. No. 10/802,537, Examiner Interview Summary mailed Oct. 24, 2008", 4 pgs.
"U.S. Appl. No. 10/802,537, Final Office Action mailed Feb. 5, 2009", 23 pgs.
"U.S. Appl. No. 10/802,537, Non Final Office Action mailed Mar. 29, 2011", 15 pgs.
"U.S. Appl. No. 10/802,537, Non-Final Office Action mailed Mar. 17, 2010", 25 pgs.
"U.S. Appl. No. 10/802,537, Response filed Jan. 18, 2011 to Non Final Office Action mailed Mar. 17, 2010", 9 pgs.
"U.S. Appl. No. 10/802,537, Response filed Dec. 7, 2009 to Final Office Action mailed Feb. 5, 2009", 10 pgs.
"U.S. Appl. No. 11/143,874, Final Office Action mailed Apr. 24, 2007", 8 pgs.
"U.S. Appl. No. 11/143,874, Final Office Action mailed Dec. 24, 2008", 14 pgs.
"U.S. Appl. No. 11/143,874, Non Final Office Action mailed Jul. 14, 2006", 6 pgs.
"U.S. Appl. No. 11/143,874, Non-Final Office Action mailed Jun. 11, 2009", 14 pgs.
"U.S. Appl. No. 11/143,874, Notice of Allowance mailed Apr. 6, 2010", 10.
"U.S. Appl. No. 11/143,874, Response filed Mar. 24, 2009 to Final Office Action mailed Dec. 24, 2008", 9 pgs.
"U.S. Appl. No. 11/143,874, Response filed Oct. 12, 2006 to Non Final Office Action mailed Jul. 14, 2006", 7 pgs.
"U.S. Appl. No. 11/143,874, Response filed Dec. 11, 2009 to Non Final Office Action mailed Jun. 11, 2009", 12 pgs.
"U.S. Appl. No. 11/275,323, Final Office Action mailed Feb. 3, 2010", 11.
"U.S. Appl. No. 11/275,323, Non-Final Office Action mailed Jun. 24, 2009", 15 pgs.
"U.S. Appl. No. 11/275,323, Response filed Nov. 24, 2009 to Non Final Office Action mailed Jun. 24, 2009", 10 pgs.
"U.S. Appl. No. 12/278,842, Response filed May 7, 2012 to Non Final Office Action mailed Jan. 5, 2012", 12 pgs.
"U.S. Appl. No. 12/278,842 Examiner Interview Summary mailed Jan. 10, 2012", 3 pgs.
"U.S. Appl. No. 12/278,842, Examiner Interview Summary mailed May 10, 2012", 3 pgs.
"U.S. Appl. No. 12/278,842, Non Final Office Action mailed Jan. 5, 2012", 9 pgs.
"U.S. Appl. No. 12/278,842, Non Final Office Action mailed Sep. 29, 2011", 10 pgs.
"U.S. Appl. No. 12/278,842, Preliminary Amendment filed Aug. 8, 2008", 3 pgs.
"Web Services Architecture", W3C Working Draft, [online]. [retrieved Jan. 21, 2009]. Retrieved from the Internet: <URL: http://www.w3.org/TR/2002/wd-WS-arch-20021114/>, (Nov. 14, 2002), 1-78.
Jewell, Tyler, et al., "Chapter 6, UDDI, Universal Description, Discovery and Integration", In Java Web Services, (Mar. 2002), 30 pgs.
"U.S. Appl. No. 11/143,874, Response filed Aug. 24, 2007 to Final Office Action mailed Apr. 24, 2007", 9 pgs.
"U.S. Appl. No. 11/143,874 response to Non-Final Office Action Sep. 17, 2007.", 12 pgs.
"Non-Final Office Action mailed Sep. 17, 2007 in U.S. Appl. No. 11/143,874", OARN, 10 pgs.
"U.S. Appl. No. 10/802,537 Non-Final Office Action mailed May 23, 2008", 25 pgs.
"U.S. Appl. No. 10/802,537, Response filed Oct. 23, 2008 to Non Final Office Action mailed May 23, 2008", 12 pgs.
"U.S. Appl. No. 11/143,874, Non-Final Office Action mailed May 13, 2008", 13 pgs.
"U.S. Appl. No. 11/143,874, Response filed Aug. 13, 2008 to Non Final Office Action mailed May 13, 2008", 12 pgs.
"International Application Serial No. PCT/US07/03536, International Search Report mailed Nov. 19, 2007", 2 pgs.
"International Application Serial No. PCT/US07/03536, Written Opinion mailed Nov. 19, 2007", 6 pgs.
Sabbouh, M., et al., "World Wide Web Consortium", *Workshop on Web Services*, (Apr. 2001), 5 pgs.

* cited by examiner

GAMING TERMINAL NETWORK WITH A MESSAGE DIRECTOR

CROSS-REFERENCE TO RELATED APPLICATIONS

This application claims priority under 35 U.S.C. Section 120 from U.S. provisional patent application Ser. No. 60/455,299, filed Mar. 17, 2003, which is hereby incorporated by reference in its entirety for all purposes.

FIELD OF THE INVENTION

The present invention relates generally to gaming networks and, more particularly, to a system and method for transmitting event messages between gaming terminals and a central system.

BACKGROUND OF THE INVENTION

Gambling has become an increasingly important and popular form of entertainment. Electronic gaming terminals are particularly important to the gaming industry as a wide variety of entertainment formats can easily be produced, capable of appealing to a broad spectrum of players. Electronic gaming terminals may, for example, include reel slot machines, video poker machines, video keno machines, and video bingo machines.

Originally, gaming machines were provided as stand alone devices that operated independently. Today, most gaming machines are networked together to a central system. The central system is generally comprised of several host computers. Each host computer (or server) is dedicated to providing a specific gaming function. These gaming functions include accounting, player tracking, and cashless gaming among others. Host computers are in serial communication with gaming terminals in a master slave communication protocol. More advanced gaming systems are becoming available that allow gaming terminals to be linked to a central server using network protocols such as TCP/IP.

Because gaming terminals are such an important source of income for the gaming industry, casinos continually seek to improve their profitability by adding new features and capabilities to gaming terminals. The networking of gaming terminals has allowed the gaming industry to incorporate new game features, as well as more sophisticated administrative gaming functions. Among these new game features are more advanced audiovisual displays, user input devices, and user-friendly interfaces. Networked systems can provide increased gaming terminal security, player tracking data, and more sophisticated financial and accounting reports.

All these gaming functions are carried out by application programs. Several different software applications may be contained in a single gaming function. Each of these software applications communicates through event messages with other software applications and other gaming equipment within the network to provide various gaming functions. These gaming functions could not be provided without this interchange of event messages.

In the past, each of these event messages was forwarded using software code embedded in each application. Remote procedure call (RPC) technology is one methodology for routing messages using embedded software code. This technology emulates the behavior of a single system running a single process, operating as a synchronized system, processing one message at a time. This technology is limited, as a client making a request on a server cannot proceed until the server responds to the client's request. This creates a highly interdependent system where a single failure of one application may cascade and create an entire system failure. This weakness in RPC type technologies is particularly apparent in gaming systems with vertically integrated applications.

In addition to susceptibility to system failure, the use of RPC technology is not conducive to systems and applications that require frequent revision. The embedded application-specific information in each application program, required to control message routing, makes software revisions extremely complicated and time consuming.

Any process utilizing this embedded software routing code generally requires extensive alteration of the inter-process communication flow and data exchange among application programs. The embedded code utilized to forward and receive messages in each of the affected applications must be reconfigured to allow for the addition of new messages or the rerouting of existing messages. Because the code is embedded in the application, and each message may route through several different applications, rewriting the code for the affected applications can become complicated and expensive for even simple modifications.

Each time improvements or additional features are added to existing gaming systems, considerable effort is required to rewrite the embedded software code used by the gaming terminal. As gaming functions are continually being revised, a new method is needed to simplify the addition of new applications and the revision of existing applications without requiring major revision of software code.

SUMMARY OF THE INVENTION

The present invention implements a message director service that operates as a software-configurable message routing system to simplify the revision and addition of application programs. This service facilitates the reliable exchange of event messages among multiple application programs within one or more gaming systems. The message director is a central service to which all other application messages are sent. Any message can be routed by the message director to one or more applications. The message director service uses a separate application program that uses routing tables in an association data structure to forward messages it receives to one or more applications. The routing tables can be dynamically configured, allowing new or existing messages to be sent to any new or existing application. The message director service allows the embedded routing code in each application to be eliminated, significantly simplifying revision of existing applications as well as the overlaying of new applications on existing systems.

Besides simplifying the writing and revision of application programs, the message director system simplifies the review of new gaming programs by gaming authorities. As gaming systems are frequently revised, significant revisions to software are often needed, which may introduce software errors. The message director service minimizes the introduction of software errors by generally confining software revisions to the message director service. This reduces or eliminates the necessity for software revisions to the applications themselves, potentially reducing the extent of any review.

In summary, the message director service provides a framework to facilitate the overlay of additional applications, or the revision of existing applications, on networked gaming system using a central and easily configurable message routing service. This provides an efficient means to upgrade or to add applications with minimal disruption to the gaming system.

DETAILED DESCRIPTION

The description of the preferred examples is to be construed as exemplary only and does not describe every possible embodiment of the invention. Numerous alternative embodiments could be implemented, using either current technology or technology developed after the filing date of this patent, which would still fall within the scope of the claims defining the invention.

Figure 1:
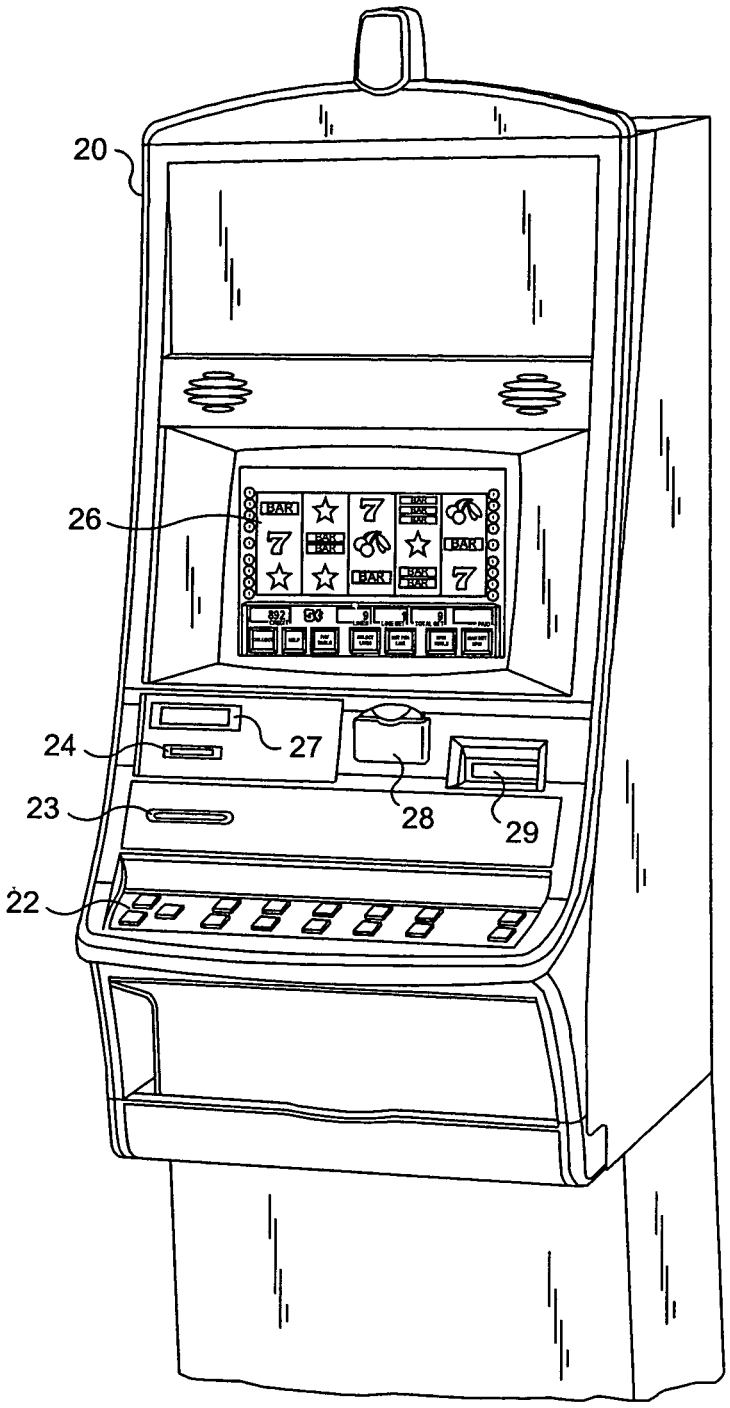
FIG. 1 is a perspective view of an embodiment of a gaming terminal.

FIG. 1 shows a perspective view of a typical gaming terminal utilized in a gaming system. The gaming terminal 20 may have varying structures and methods of operation. For example, the gaming terminal 20 may be a mechanical gaming terminal configured to play mechanical slots, or it may be an electro-mechanical or electronic gaming terminal configured to play a video casino game such as blackjack, slots, keno, bingo, poker, etc. Typical components found in a gaming terminal 20 are described below. It should be understood that numerous other elements may exist and may be used in any number of combinations to create a variety of gaming terminal types.

The game itself is displayed to the player on a visual display 26, such as a video display. Instead of a video display, the gaming terminal 20 may have several mechanical reels to display the game outcome. The video display may take the form of a cathode ray tube (CRT), a high resolution LCD, a plasma display, LED, or any other type of video display suitable for use in a gaming terminal.

The visual display 26 may include a touch screen overlaying the monitor to allow players to make game related selections. A push button panel 22 is also typically offered, in addition to the touch screen, to give players an alternative method for making gaming selections.

A wager acceptor may include a coin slot acceptor 28 or a note acceptor 29 to enter monetary value to the gaming terminal 20. In addition to accepting currency, the gaming terminal 20 may have a ticket printer 23 that may print and/or read or otherwise encode ticket vouchers with a monetary value. The encoded ticket voucher may also have the casino name, type of voucher, validation number, and a bar code with control and/or security data.

Many gaming terminals are also equipped with a player tracking card reader 24. A player may be enrolled in the gaming establishment's player club and may be awarded certain complimentary offers as that player collects points on his player tracking account. The player inserts the player tracking card into the reader, allowing the gaming establishment's player tracking server **10*b* to record the player's wagering activity. The gaming terminal 20 may also include a player tracking display 27 to be used with the player tracking card and card reader 24**.

Figure 2:
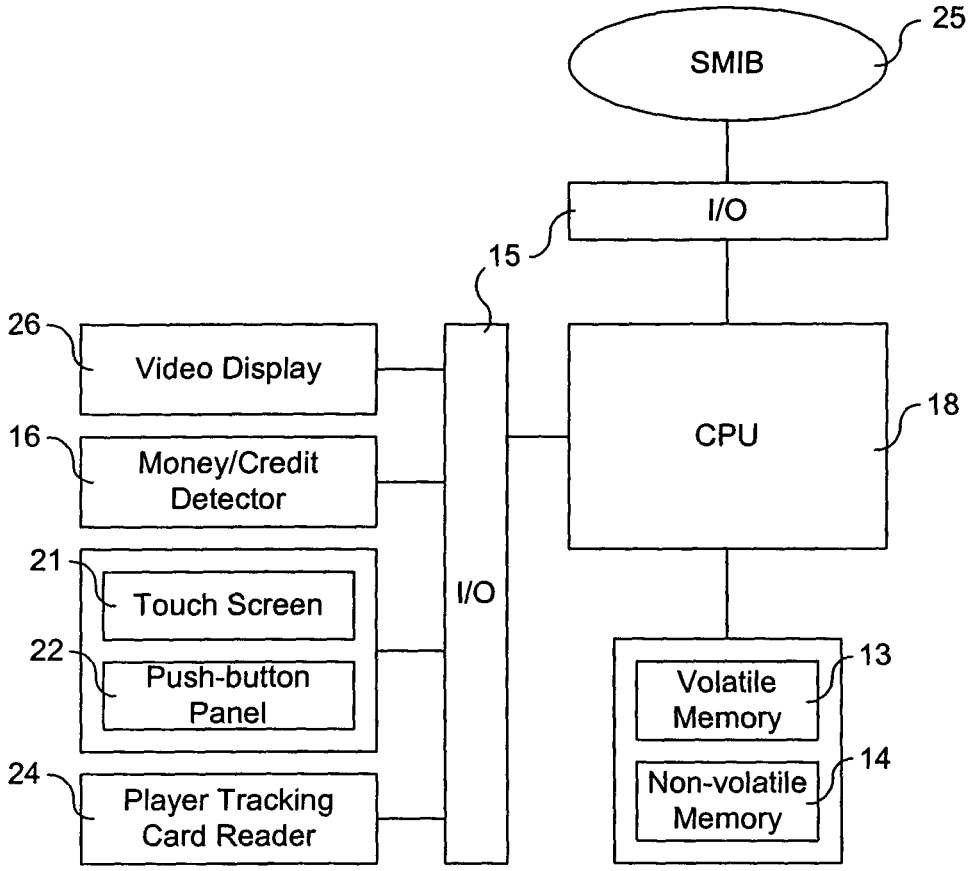
FIG. 2 is a block diagram of the electronic components typically used in the gaming terminal of FIG. 1.

The gaming terminal is controlled by a central processing unit (CPU) 18, as shown in FIG. 2. The CPU 18 executes the game program and controls the gaming terminal's peripheral devices. These peripheral devices may include a touch screen 21, a push button panel 22, a player tracking card reader 24, a video display 26, etc (as discussed above). The number and the type of peripheral devices may be different from those depicted in FIG. 2 depending on the desired configuration of the gaming terminal.

The CPU 18 controls the peripheral devices and the execution of the game program using a volatile memory 13 (e.g., a random access memory (RAM)), a non-volatile memory 14 (such as an EEPROM), and an input/output (I/O) circuit 15. It should be appreciated that although only one microprocessor is shown, the central processing unit may include multiple microprocessors. Similarly, the memory of the central processing unit may include multiple RAM and multiple program memories.

Figure 3:
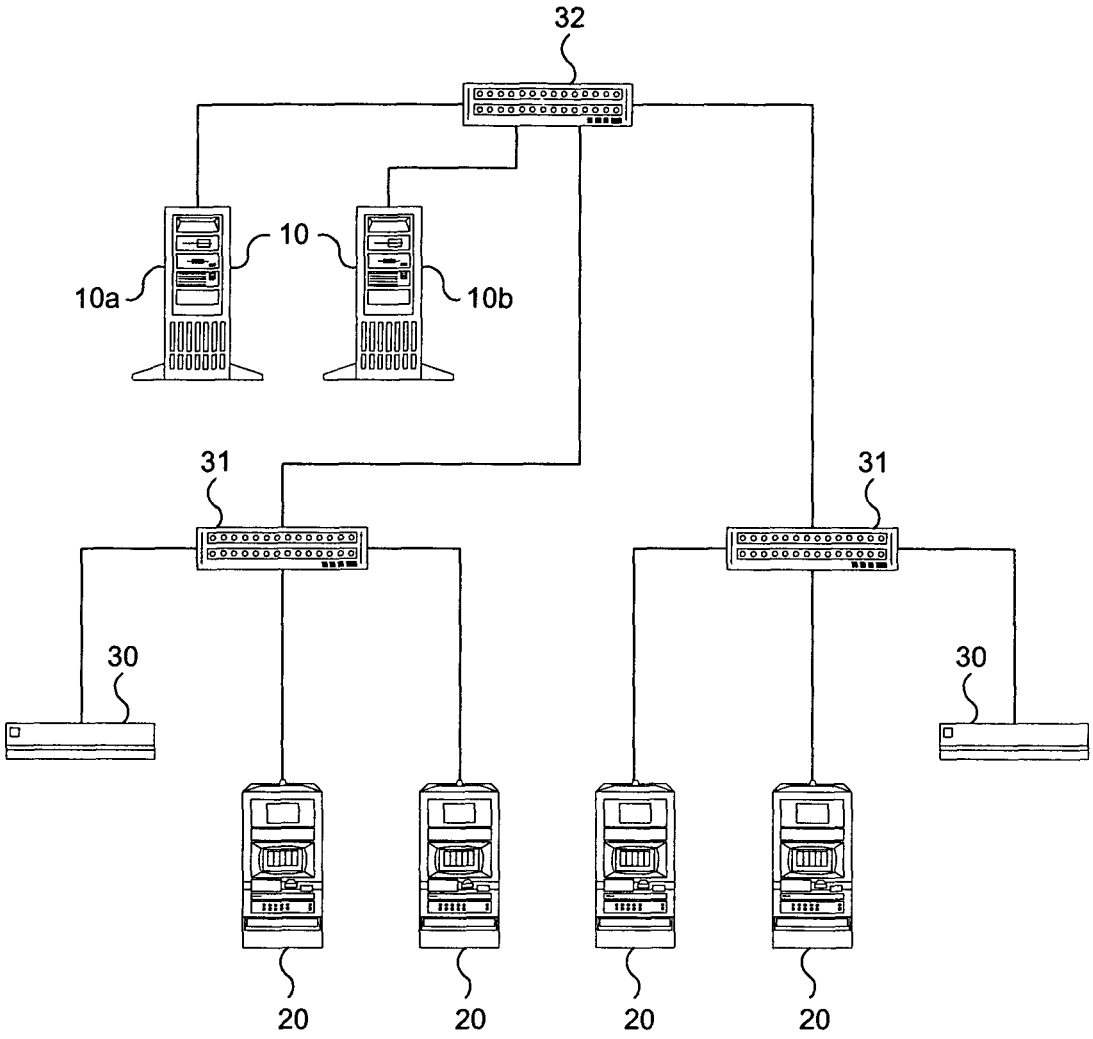
FIG. 3 is a diagram of gaming terminals networked into a gaming system.

The gaming terminals may be networked into a gaming system. The gaming terminal's CPU 18 is in communication with a server 10 (or servers) controlling the network of gaming terminals. FIG. 3 shows a typical gaming system utilizing gaming terminals 20 connected in serial communication with a server 10 utilizing a master slave protocol. Various switches 32 and carousel controller 31s increase the network's communication efficiency. A carousel controller 31 may be used to link a local bank of gaming terminals 20. Each carousel controller 31 may further be connected to a site server 10. Most gaming systems currently utilize several different servers **10*a*, 10*b***, with each dedicated to performing a specific gaming function. Described below are the most commonly used dedicated servers in local area networks.

The accounting server **10*a* monitors the financial transactions occurring on each individual gaming terminal 20** by collecting data such as credits in, out, played, and won, and the denominations of games played. The amount and types of collected audit data may be varied to suit a particular casino. Accounting reports may be compiled based on the data received from each of the individual gaming terminals.

The player tracking server **10*b* tracks individual player usage of the gaming terminals 20. When a player enrolls in a casino player tracking system, often called a "slot club" or "rewards program," the casino issues a player identification card encoded with a player identification number that uniquely identifies the player. The identification card may, for example, be a magnetic card or a smart (chip) card. Each gaming terminal 20 is fitted with a card reader 24 into which the player inserts his or her identification card before playing the associated gaming terminal 20. The card reader reads the player's identification number from the card and communicates the player's gaming activity to the player tracking server 10*b***. This allows the gaming establishment to target individual players with direct marketing techniques, comps, and other rewards.

Other dedicated servers may also be utilized on the gaming network. For example, many casinos utilize a cashless gaming server to manage and validate electronic funds transactions. The cashless gaming server may store funds in monetary accounts in the server, authorize the transfer of funds between accounts and gaming terminals 20, and associate the accounts with portable instruments such as cards or tickets used by players at the gaming terminals 20.

The servers 10 described above are typically found in gaming establishments and generally function independently to perform their specific gaming functions. Each server 10 accepts event messages from the gaming terminals and processes them to accomplish a specific gaming function. The same event message may go to more than one server 10. Furthermore, the gaming function on each of the above servers 10 may comprise several application programs that require and utilize the same event messages.

Figure 4:
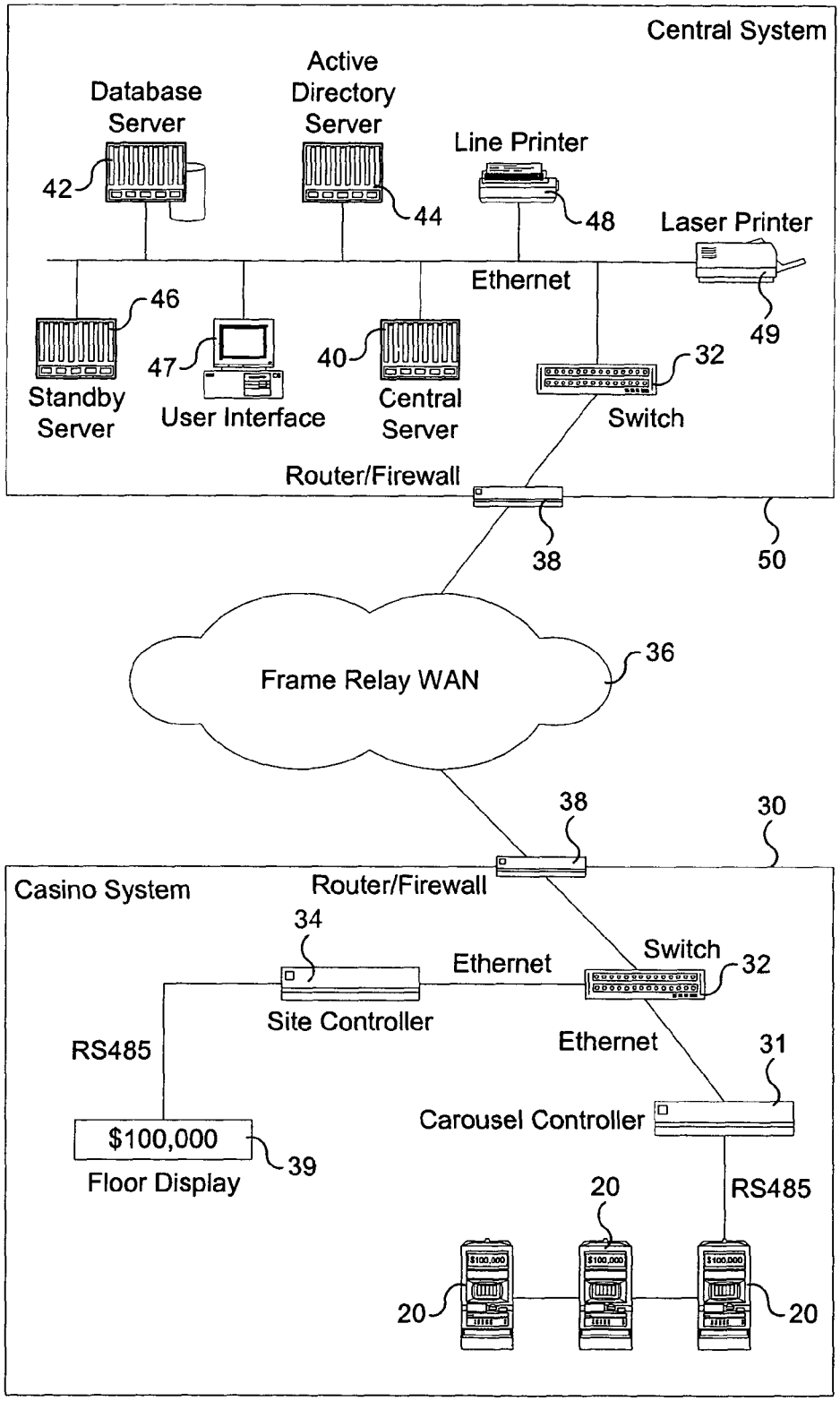
FIG. 4 is a diagram of a progressive gaming system.

Wide area networks have also been established by casinos to link LAN's to provide wide area progressive (WAP) games to multiple sites as shown in FIG. 4. The wide area progressive games provide a progressive jackpot that increases incrementally in value each time a gaming terminal on the network is played. With the wide area network, many gaming terminals can be linked into a single progressive game, allowing substantial jackpots to be quickly accumulated. These wide area progressive games are particularly message intensive because of the need to coordinate and register the wagers from multiple sites and potentially hundreds of gaming terminals. Because of the complexity of the progressive gaming system and the intensive use of event messages, the progressive gaming system will be used to exemplify how the message director simplifies software programming.

As can be seen from FIG. 4, wide area progressive systems typically include a central system 50, with a central server 40 to process wagering information and to update the progressive game jackpot. The central server 40 is supported by a database server 42 to support the calculation of the progressive jackpot. In addition, an active directory server 44 is utilized to facilitate the support of hardware on the system including a line printer 48, a laser printer 49, a user interface 47, a router 38, and a switch 32. A standby server 46 is also on the network if the central server 40 fails. The central system 50 connects through the router 38 to a wide area network 36, which connects to a gaming establishment's progressive local area network 30.

The progressive local area network 30 has a site controller 34 in communication with each of the progressive gaming terminals 20 through an Ethernet type communication channel. If desired, the gaming terminals 20 can be centrally connected to a carousel controller 31. The site controller 34 is also connected to a floor display 39, which provides signage for the progressive jackpot amount. A switch 32 and router 38 can also be utilized to increase network communication efficiency.

Figure 5:
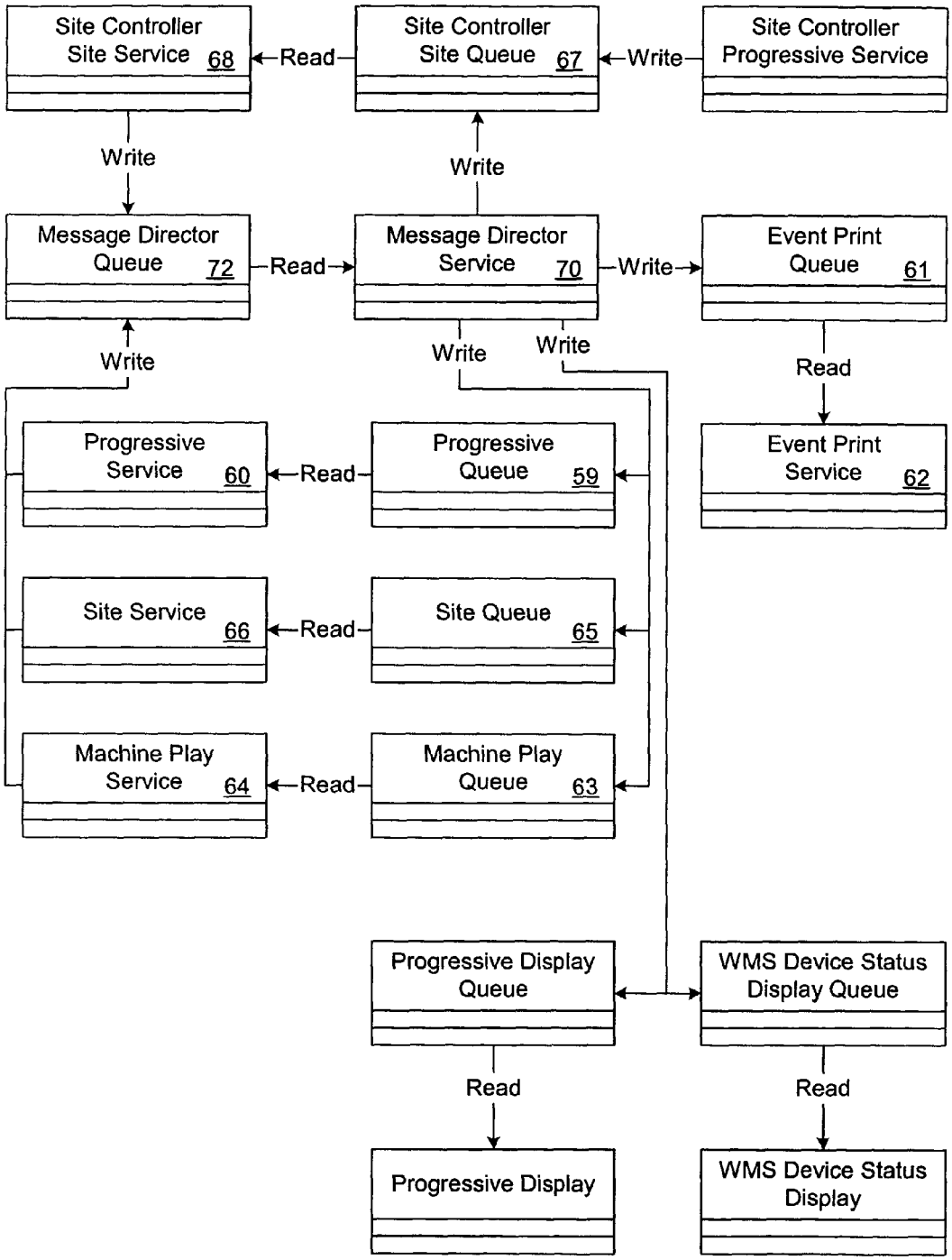
FIG. 5 is a flow chart of the applications used in a typical progressive gaming system and their associated message queues.

The progressive gaming system's central server 40 operates using several different software applications as shown in FIG. 5. These include the progressive service 60, the event print services 62, the machine play service 64, the site service 66, and the site controller site service 68. The progressive service 60 updates the floor display 39 and manages awards. The event print service 62 prints events to the operations line printer 48 to maintain a log of events for regulatory authorities. The machine play service 64 collects handle pull information at the central system 50 from the gaming terminals. The site service 66 manages site controllers networked to the central system 50. The site controller's site service 68 manages gaming terminals at the casino level. To control and coordinate these different applications, the Wide Area Progressive (WAP) central server 40 requires a sophisticated game management data capability that can send and receive event messages within the central system 50. Not only must event messages be shared among application programs, but also sent to the local area network and its equipment.

Gaming terminals generate many event messages processed by the system's application programs. These event messages may be termed primary event messages and typically result from physical events. Primary event messages are not generated from the processing of a preceding event message. The gaming terminals can generate a number of different possible event messages. These event messages may relate to accounting and such functions as the calculation of the progressive jackpot, tracking wagers that are being placed on the gaming terminal, and tracking payouts earned at each gaming terminal. Still, other event messages may relate to security concerns such as open-door events and the refilling of coin hoppers. Finally, some event messages are required to satisfy jurisdictional requirements. Each of these event messages must be communicated to the central server 40 for processing.

The event messages may be sent to multiple applications within the progressive gaming system. Processing of each of these primary event messages may in turn generate new event messages. The event messages resulting from processing of the primary event messages may be termed secondary event messages. This can result in the generation of a cascade of secondary event messages, which must then be routed to various application programs within the central system 50. The event messages can also be communicated to the casino's local area network 30 and to its constituent devices such as gaming terminals 20, site controller 34, carousel controller 31, and the floor display 39, etc.

Because of the complexity of application programs, the number of different event messages, and the interaction of application programs creating secondary event messages, significant resources are expended embedding software routing instructions in each application. Even more resources are expended when an application must be revised to reroute event messages. The message director replaces this embedded routing code with a central message routing system.

To simplify the exchange of event messages, the message director service 70 uses a software-configurable message routing system for the reliable exchange of event messages among multiple applications as shown in FIG. 5. The message director can easily be configured to handle multiple types of applications and application messages, as well as multiple servers. In systems that have multiple processors, the message director can be replicated across multiple processors to increase computing resources. As all messages are directed first to the message director, a focal point is created through which all applications may communicate. Consequently, the message director is scalable and can be expanded to accommodate additional applications or messages as the system architecture or applications change.

To accommodate the multiple applications to which the event message must be sent, all event messages are first sent to the message director service 70 on the central server 40. The message director then determines which applications are to receive the event message. Message queuing forwards the event message to the application queue (e.g., 59, 65, 63, 61, and 67) designated specifically for that application. As can be seen from FIG. 5, each of the application programs cited above has an associated message queue. For example, the message director service 70 is associated with message director queue 72. Likewise, the site service 66 is associated with site queue 65, machine play service 64 with machine play queue 63, event print service 62 with event print queue 61, and finally, site controller service 68 with site controller site queue 67. The message queue of the message director service facilitates the routing of messages and is known more specifically as a routing queue 72. The message queues of all other applications are known more specifically as application queues (e.g., 61, 63, 65, and 67).

The message director may utilize the message queuing capability of such commercial off-the-shelf products as MICROSOFT MESSAGE QUEUING (MSMQ) and IBM's MQ SERIES. These software application packages are typically generically called message oriented middleware (or MOM). These generic programs provide spatial and temporal decoupling of the message from the sender to the intended recipient.

One advantage of message queuing is the asynchronous messaging capability that allows messages to be stored until they are needed or called on (the application itself is responsible for retrieving messages from its queue). The ability to write out messages to a persistent store allows message queuing to prioritize messages and guarantee message delivery.

Message queuing guarantees message delivery through a store-and-forward mechanism that delivers the message to the next processing component in the system as soon as it becomes available. If the application is off-line, the message director in combination with message queuing stores the message in a queue on a hard disk drive. Once back online, the event messages stored on disk can be retrieved from the point that communications were interrupted and forwarded to the appropriate application.

Another advantage of message queuing is that it can prioritize all event messages. Message prioritization helps guarantee adequate response time for critical applications at the expense of less important applications.

Figure 6:
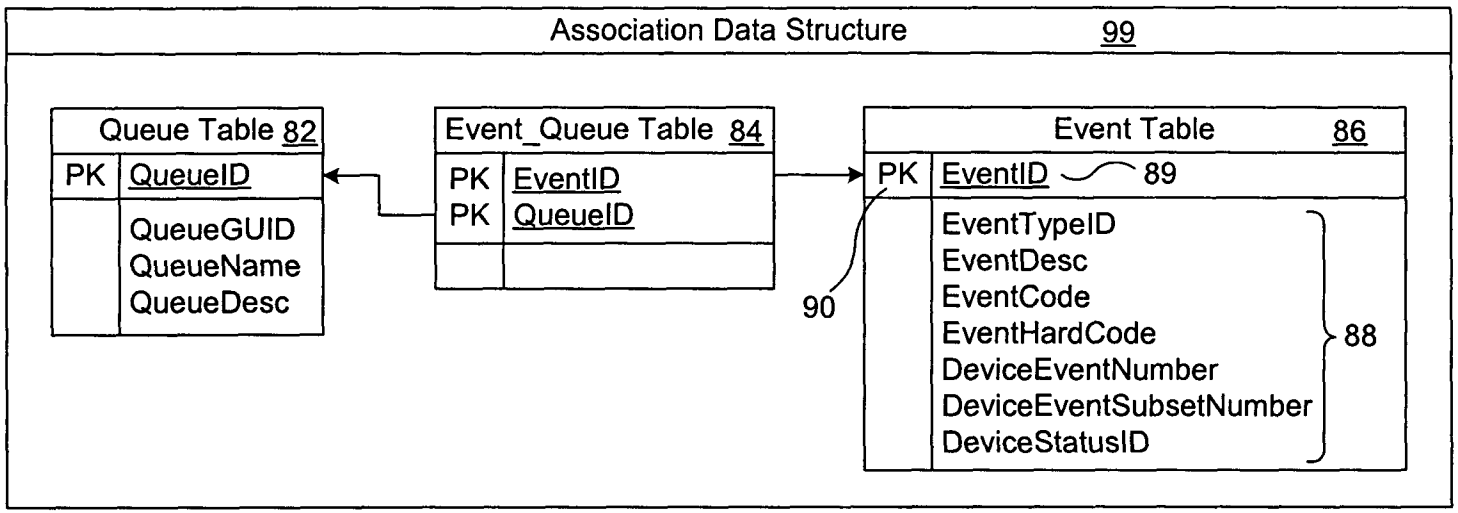
FIG. 6 illustrates an association data structure and its routing tables.

The message director service operates with a series of routing tables as can be seen from FIG. 6. The message director relies on these routing tables, known collectively as the association data structure 99, to forward messages to the appropriate application. The association data structure 99 uses three database tables: the queue table 82, the event queue table 84, and the event table 86. These tables store configuration information relating to event messages and the application message queues to which they are routed. The three database tables function together to ensure that an event message is routed to all applications that require that particular message.

For example, the event table 86 contains all the information to uniquely identify each event. Each event message is associated with a unique identifier. This unique identifier is eventID 89 depicted in FIG. 6. Event table 86 associates an event ID 89 and associated data record 88 containing information required to process the message. The combination of the event ID 89 and the data record 88 creates an event message. As can be seen from FIG. 6, the data record 88 has several data fields. These data fields include event type ID, event description, event code, event hard code, device event number, device event subset number, and device status ID. Each of these data fields provides information that allows the event message to be appropriately processed. The event queue table 84 matches the unique identifier of each event ID 89 to all the message queues that require this event message.

The event queue table 84 contains information necessary to show the relationship between an event and the message queue(s) to which the event message must be sent. An event can be listed multiple times in the event queue table if it is related to multiple message queues. Likewise, a particular message queue can be listed multiple times in event queue table 84 if there are multiple event messages that need to be sent to that queue. As can be seen from FIG. 6, event queue table 84 contains a message queue (queue ID) to which the event message is associated.

The queue table 82 contains all the information the message director requires to open a message queue table to send or receive event messages to or from the queue. The queue table 82 also contains identifying attributes of the queue necessary to simplify the processing of the event message.

Figure 7:
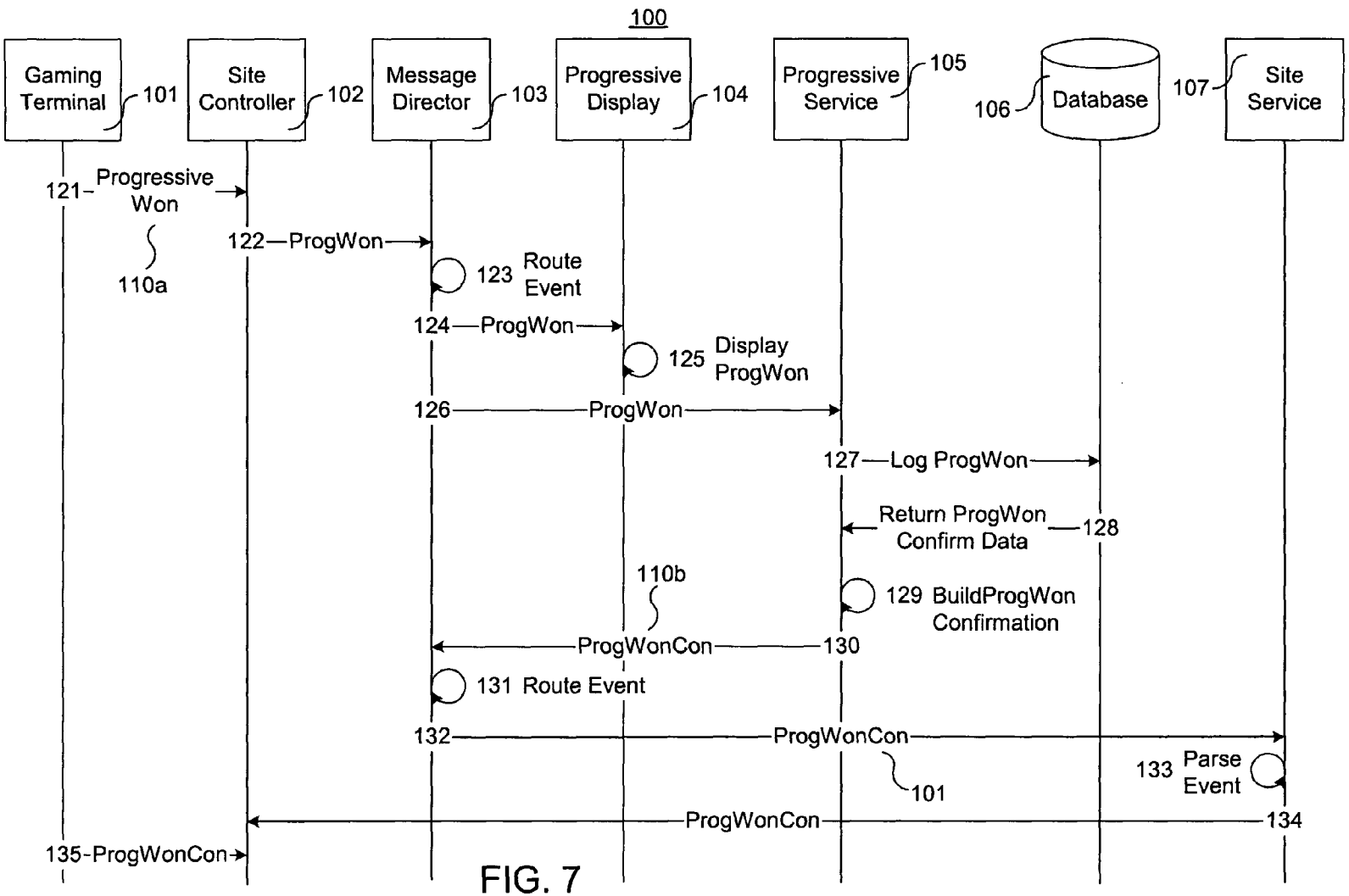
FIG. 7 is a software flowchart illustrating the progressive won sequence in a wide area progressive gaming system.

To illustrate how the message director functions, FIG. 7 displays a flowchart of the operation of the message director and the generation and processing of event messages 100. When an event message is generated from a gaming terminal (or from an application residing on the progressive server itself), the event message is sent to the message director queue. The message director retrieves the event message and identifies the event message ID. The message director associates the event message ID to all applicable event queues. The original event message is then sent to all applicable queues for delivery to each application identified.

For example, in FIG. 7 a gaming terminal 101 has won the progressive jackpot and created a Progressive Won (ProgWon) event message 121. The ProgWon event message notifies the central system that the progressive has been won. This message is a primary message 110*a* as it was not generated by a previous event message.

In this example, the progressive won event message 121 is generated at the gaming terminal 101 and relayed through the site controller 102 at the casino to the message director queue 103 on the central server 40. As described above, the message director determines the message queues to which the event message is directed. In this example, the message director sends the ProgWon event message to two different applications: the progressive service 105 and the progressive display 104.

The progressive display 104 provides notice to the operator of significant system events. As a result of the ProgWon event message to the progressive display, a flashing note appears on the CRT that notifies the operator that the progressive has been won.

The progressive service 105 establishes confirmation that the jackpot has been won and returns a progressive won confirmation (ProgWonCon) event message 130 back to the originating gaming terminal 101 in a series of steps. The progressive service 105 first relays the ProgWon message to the database 106 for storage. The database 106 returns data to the progressive service 105 allowing the progressive service 105 to generate a progressive won confirmation (ProgWonCon) event message 130. The ProgWonCon is a secondary event message 110*b* generated as a result of a primary event message. The message director 103 receives the ProgWonCon event message 130 and determines the applications to which the event message is to be sent. In this example, only the site service 107 receives the progressive won confirmation message. The site service 107 determines which site controller 102 sent the progressive won event message. The progressive won confirmation event message is then sent to the identified site controller 102. The site controller 102 relays the progressive won confirmation message to the winning gaming terminal 101. This completes the message routing that results from the initiation of a ProgWonCon event message 121 from the gaming terminal 101.

Although the flowchart shown in FIG. 7 does not contain any message queues for the various applications, it is possible, as shown in FIG. 5, to associate a message queue with each application. A message queuing system is not essential for the operation of the message director, but it does allow the message director to operate more efficiently and reliably. In lieu of the message queuing system, the message director could utilize any standard network connectivity model and any standard method of reliable message delivery.

To incorporate even further flexibility in the message director system, the event messages may be encoded using an Extensible Markup Language (XML) schema. This facilitates the exchange of data messages among applications that may not use the same proprietary communication protocols. The XML standard is a means of exchanging data among systems where the need for interface definition is developed against a common agreed-upon schema that is readily extensible while maintaining compatibility with existing implementations. The present invention is not limited to the use of the XML language and any other appropriate language could be used.

The advantage of the XML schema is that it allows systems that utilize different proprietary communication standards to communicate with one another. This is a particularly important advantage the gaming industry where many different proprietary communication protocols exist within gaming systems. Through a common XML schema, data communications between systems that utilize unfamiliar and foreign communication protocols can be readily translated without access to proprietary vendor communication protocols. The XML schema allows information to be transmitted to any number of otherwise incompatible software applications.

In one embodiment, as shown in FIG. 4, the XML schema is implemented in the message director system through the capture of data elements transmitted from a gaming terminal 20 to a carousel controller 31. This system typically employs a proprietary serial protocol. In turn, the carousel controller 31 is typically in serial communication with a site controller 34 (in some instances the carousel controller 31/site controller is replaced with a single site controller). The data elements are translated into a common XML schema and transmitted electronically from the carousel controller 31 through Transmission Control Protocol/Internet Protocol (TCP/IP) across a local area network (LAN) 30 within a gaming site to a site controller 34 device. The site controller 34 then communicates across a Wide Area Network (WAN) 36 using a standard message queuing software program to the message director. The message director in turn distributes the event message to a set of applications residing on a single or multiple servers. The data in the event messages are ultimately posted to a central system database server 42.

Likewise, data transmissions from the central system 50 and central system database server 42 are converted into an XML schema and transmitted electronically through the data network to the carousel controller 31, which then translates the XML schema and contained data elements into a format that can be transmitted to a proprietary gaming terminal. Any designated system component can communicate with an external system via the XML protocol.

The message director system may be further enhanced when configured to run on WINDOWS SERVICES. WINDOWS SERVICES are applications that run in the background and perform tasks that do not require user interaction. This configuration is important for the automatic processing of application messages. For example, the message director system can run without a user session. This means that an operator is not required for WINDOWS SERVICES to run, insuring the availability of the system. In addition, WINDOWS SERVICES can be configured to start automatically when the operating system starts, insuring the functionality of the system. The WINDOWS operating system can automatically restart WINDOWS SERVICES that has ended abnormally without user intervention. In essence, WINDOWS SERVICES provides an administrative tool to ensure that the message director system is always available and ready to operate the gaming system. However, the use of WINDOWS SERVICES is entirely optional as it is not essential to the operation of the message director system.

Figure 8:
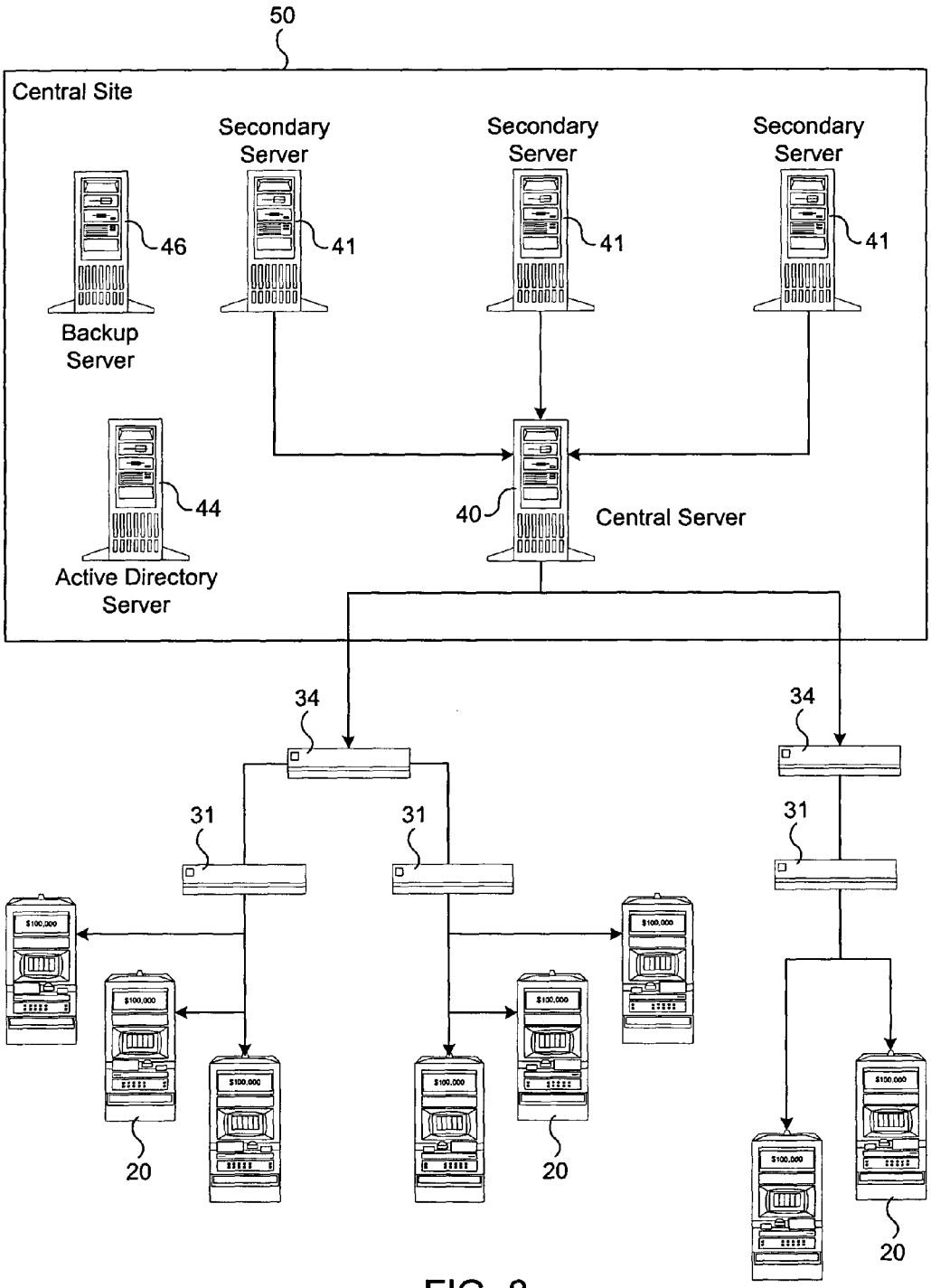
FIG. 8 is an alternative embodiment of a progressive gaming system utilizing a central server dedicated to message routing.

The message director service can also be used with any number of other hardware architectures. One of these embodiments places the message director service on a dedicated central server 40 as shown by FIG. 8. Event messages may be sent from several different progressives and routed through the message director server to a number of independent progressive systems, each independently controlling a specific progressive game. An independent secondary server 41 controls each of these progressive games. Each of these secondary servers 41 in turn may have a secondary message director dedicated to managing all internal secondary event messages generated within the secondary server 41.

Furthermore, although the above examples described the operation of the message director service with a progressive gaming system, it should be understood that the message director could route messages to other network servers not associated with a wide area progressive gaming system. For example, messages that originate within the progressive gaming system could also be sent to the player tracking server 10*b*, the accounting server 10*a*, the cashless gaming server, and others as well. For instance, certain messages might be required by both the player tracking server 10*b* and the progressive gaming server. Both applications could coexist on the same network processor and disk set. A single message could be routed to both applications on a single system or to multiple systems.

Furthermore, another embodiment does not require the system to be associated with any progressive game. The message director service can also be applied to typical local area networks used by gaming establishments as shown in FIG. 3. The message director service can be applied to any gaming function and to any number of other LANs in a gaming system. In the example of the LAN shown in FIG. 3, any of the servers 10 may be designated as a central server on which the message director service may function. Alternately, a message director service could be established on each server 10 shown in FIG. 3.

While the present invention has been described with reference to one or more particular embodiments, those skilled in the art will recognize that many changes may be made thereto without departing from the spirit and scope of the present invention. Each of these embodiments and obvious variations thereof is construed as falling within the spirit and scope of the claimed invention, which is set forth in the following claims.

What is claimed is:

1. A method of communication in a gaming network having a central server linked to a plurality of gaming terminals, the method comprising:

receiving a primary event message in a routing queue of the central server from one of the plurality of gaming terminals;

identifying, using an association data structure, a first application queue associated with a first application configured to process the primary event message, the association data structure implemented using a relational database and storing an association of the primary event message to at least the first application queue; and transmitting the received primary event message to the identified first application queue.

2. The method of claim 1, further including:

retrieving the primary event message from the first application queue with the first application; and processing the primary event message with the first application.

3. The method of claim 2, further including:

generating a secondary event message from the processing of the primary event message;

transmitting the secondary event message to the routing queue of the central sever;

identifying a second application queue associated with a second application configured to process the secondary event message using the association data structure, the association data structure storing an association of the secondary event message to the second application queue; and transmitting the secondary event message to the identified second application queue.

4. The method of claim 2, further including executing the first application on a secondary server in communication with the central server.

5. The method of claim 4, further including:

generating a secondary event message from the processing of the primary event message;

transmitting the secondary event message to the routing queue of the central server;

identifying a second application queue associated with a second application configured to process the secondary event message using the association data structure, the association data structure storing an association of the secondary event message to the second application queue; and transmitting the secondary event message to the second application queue.

6. The method of claim 1, wherein the gaming terminal generates the primary event message.

7. The method of claim 3, further comprising identifying, using the secondary event message, the gaming terminal that generated the primary event message.

8. A gaming network comprising:

a gaming terminal for generating an event message; and a central server in communication with the gaming terminal, the central server including:

a routing queue operable to receive a plurality of event messages including the event message for one or more applications, a plurality of application queues, each application queue operable to receive one or more event messages of the plurality of event messages, each application queue associated with an application of the one or more applications to process the received one or more event messages in each respective application queue, an association data structure, implemented using a relational database and operable to establish an association between the plurality of event messages and at least one application queue of the plurality of application queues, wherein the central server is operable to receive the plurality of event messages in the routing queue, identify via the association data structure at least one application queue of the plurality of application queues corresponding to the received plurality of event messages and transmit the received plurality of event messages to the at least one application queue identified via the association data structure.

9. A method of communication in a gaming network having a central server linked to a plurality of gaming terminals, the method comprising:

receiving a primary event message in the central server from one of the plurality of gaming terminals, the central server including an association data structure implemented using a relational database, the association data structure associating the primary event message with at least one application configured to process the primary event message;

identifying, using the association data structure, at least one application to process the primary event message; and transmitting the received primary event message to the identified at least one application for processing.

10. A method of communication in a gaming network having a central server linked to a plurality of gaming terminals, the method comprising:

receiving a primary event message in a routing queue of the central server from one of the plurality of gaming terminals;

identifying, using an association data structure, a first application queue associated with a first application configured to process the primary event message, the association data structure implemented using a relational database and storing an association of the primary event message to the first application queue;

identifying a second application queue associated with a second application configured to process the primary event message using the association data structure, the association data structure storing the association of the primary event message to the second application queue; and transmitting the received primary event message to the identified first and second application queues.

11. The method of claim 10, wherein the transmitting the received primary event message to the identified first and second application queues includes using message queuing, the message queuing including a store-and-forward mechanism.

12. The method of claim 11, wherein the message queuing prioritizes messages received in the first and second application queues, the prioritization configured to guarantee adequate response time for a critical application at the expense of a less important application.

13. The method of claim 12, wherein the primary event message is formatted using a standardized interface language.

14. The method of claim 13, wherein the standardized interface language includes an extensible markup language (XML).

15. The method of claim 1, wherein identifying the first application queue associated with the first application configured to process the primary event message comprises:

determining an event type associated with the primary event message; and determining, using the relational database, a queue identifier related to the event type, the queue identifier identifying the first application queue.

16. The method of claim 1, further including using a message oriented middleware to receive the primary event message in the routing queue of the central server, transmit the received primary event message to the identified first application queue, and retrieve the primary event message from the first application queue with the first application.

17. The method of claim 16, wherein the message oriented middleware is configured to prioritize one or more primary event messages in the routing queue of the central server.

18. A method of communication in a gaming network having a central server linked to a plurality of gaming terminals, the method comprising:

receiving a primary event message in a routing queue of the central server from one of the plurality of gaming terminals;

identifying, using an association data structure, a first application queue associated with a first application configured to process the primary event message, the association data structure implemented using a relational database and storing an association of the primary event message to at least the first application queue;

transmitting the received primary event message to the identified first application queue;

retrieving the primary event message from the first application queue with the first application;

processing the primary event message with the first application;

identifying a second application queue associated with a second application configured to process the primary event message using the association data structure, the association data structure storing an association of the primary event message to the second application queue; and routing the primary event message to the second application queue.

* * * * *